US005907960A

United States Patent [19]

Lonati et al.

[11] Patent Number: 5,907,960

[45] Date of Patent: Jun. 1, 1999

[54] CLOSED TOE METHOD ON A SINGLE-CYLINDER KNITTING MACHINE

[75] Inventors: Francesco Lonati; Ettore Lonati; Fausto Lonati; Tiberio Lonati, all of Brescia, Italy

[73] Assignee: Lonati S.p.A., Monza, Italy

[21] Appl. No.: 08/985,190

[22] Filed: Dec. 4, 1997

[30] Foreign Application Priority Data

Dec. 20, 1996 [IT] Italy ..... MI96A2712

[51] Int. Cl.[6] ..... D04B 9/56

[52] U.S. Cl. ..... 66/28; 66/58; 66/16; 66/148; 66/187

[58] Field of Search ..... 66/16, 15, 28, 66/30, 187, 148, 34, 63, 31, 32, 58

[56] References Cited

U.S. PATENT DOCUMENTS

| | | | |
|---|---|---|---|
| 1,807,431 | 5/1931 | Page | 66/48 |
| 4,454,729 | 6/1984 | Lonati | 66/28 |
| 5,203,184 | 4/1993 | Lonati et al. | 66/28 |
| 5,487,281 | 1/1996 | Frullini et al. | 66/13 |
| 5,570,591 | 11/1996 | Frullini et al. | 66/148 |
| 5,727,400 | 3/1998 | Lonati et al. | 66/148 |

FOREIGN PATENT DOCUMENTS

| | | |
|---|---|---|
| 0 756 029 | 1/1997 | European Pat. Off. . |
| 0 803 599 | 10/1997 | European Pat. Off. . |
| 1 635 992 | 7/1971 | Germany . |
| 9 637 649 | 11/1996 | WIPO . |

*Primary Examiner*—Andy Falik
*Attorney, Agent, or Firm*—Guido Modiano; Albert Josif

[57] ABSTRACT

Method for manufacturing a tubular hosiery item with a closed end, with a single-cylinder circular knitting machine having a pivoting semicircular plate having radially sliding hooks, including alternately rotating the needle cylinder for moving the needles of a first half of the needle cylinder and the hooks of the overlying semicircular plate to pass in front of a feed of the machine; the extracted hooks forming a support for a thread dispensed at the feed, actuated needles being actuated so as to take up the thread and be alternated with inactive needles, subsequently swapping the actuated needles with the inactive needle when the motion of the needle cylinder is reversed; a first needle of the needles of a second half of the needle cylinder is also made to pass in front of the feed to take up the thread, in order to allow both end hooks of the hooks of the semicircular plate to engage the thread; retracting the hooks of the semicircular plate so as to retain the engaged thread; forming heel knitting with the needles of the first half of the needle cylinder that have taken up the thread; folding over the semicircular plate so that the hooks which have retained the thread face the needles of the second half of the needle cylinder; extracting the hooks from the semicircular plate and actuating the needles of the second half of the needle cylinder while the cylinder is rotated continuously about its own axis so as to form loops of knitting by the needles of the second half of the needle cylinder, the loops meshing with the thread carried by the hooks of the semicircular plate, which are then retracted into the semicircular plate in order to release the previously held and transferred thread; and actuating the machine in order to complete the item.

6 Claims, 3 Drawing Sheets

CLOSED TOE METHOD ON A SINGLE-CYLINDER KNITTING MACHINE

BACKGROUND OF THE INVENTION

The present invention relates to a method for manufacturing tubular items having a closed end, such as hosiery items or the like, with a single-cylinder circular machine.

Hosiery items are currently manufactured by means of circular hosiery-making machines which form the item usually starting from the upper end of the leg and ending the manufacturing process at the toe, leaving said toe open.

The hosiery items must therefore be subjected to a subsequent sewing or looping operation to close the toe in order to form the finished product.

In view of the fact that the toe closure operation significantly affects the production cost of hosiery items, in recent years methods have been proposed, and machines have been studied, which are meant to manufacture hosiery items with a closed toe, i.e., which obtain, at the output of the circular machine that manufactures them, hosiery items in which the toe is already closed.

The methods proposed so far, however, are unable to obtain a hosiery item with a closed toe which has a degree of finish and/or a production quality which is comparable with that which can be obtained with the conventional looping operation.

The processes that have been tested have clearly pointed out the problem of a considerable increase in the production times of hosiery items or in any case a time increase which makes it economically disadvantageous to manufacture them.

U.S. Pat. No. 5,727,400 discloses a method for producing closed toe hosiery with a single-cylinder circular knitting machine which has a fold-over half-platen carrying radially sliding thread engagement elements. The method includes rotating the knitting machine cylinder about the cylinder axis with 180 degree oscillations to pass a first half of the needle cylinder and the half-platen arranged thereabove in front of a thread feed, whereupon the fed thread is supported upon extracted hook ends of the thread engagement elements, and engaging the supported thread with selected needles of the cylinder for each oscillation. The thread engagement elements are then retracted into the half-platen while retaining the thread or threads supported thereon, and heel knitting takes place with the needles of the first half of the needle cylinder. The half-platen is then folded over so as to face a second half of the needle cylinder to whose needles the thread or threads retained by the engagement elements of the half-platen are passed in the toe-closing operation, whereupon subsequently the remaining portion of the hosiery is knit. While this method for producing closed toe hosiery performs admirably, there is still the need to provide improvements in the toe-closing operation of a tubular knit item.

SUMMARY OF THE INVENTION

The aim of the present invention is to provide a method which allows the manufacture of tubular items, such as hosiery items or the like, in which the toe is closed directly in the single-cylinder circular machine that produces them, in an economically competitive manner.

Within the scope of this aim, an object of the present invention is to provide a method which allows to obtain hosiery items with the toe closed directly in a single-cylinder circular machine with a quality which can be compared with the quality that can be obtained with the conventional looping operation.

In accordance with the invention, there is provided a method for manufacturing a tubular hosiery item with a closed end, with a single-cylinder circular knitting machine, which is provided with a semicircular plate and a needle cylinder, the semicircular plate facing, in an upward region, a first half of the needle cylinder, the semicircular plate being adapted to fold over about a diametrical axis of the needle cylinder in order to face a second half of the needle cylinder, hooks being provided on the semicircular plate which are radially movable with respect to an axis of the needle cylinder, the hooks being equal in number to a number of needles located in an underlying half of the needle cylinder selected from the first and second halves of the needle cylinder such that each hook is laterally adjacent to a needle of the underlying half of the needle cylinder, in which the method includes:

a first step, during which the needle cylinder is rotated alternately about the axis of the needle cylinder with at least one forward movement and one return movement, for moving the needles of the first half of the needle cylinder and the hooks of the overlying semicircular plate so that the needles of the first half of the needle cylinder and the hooks of the semicircular plate pass in front of a feed of the machine; the hooks of the semicircular plate being partially extracted, during the first step, radially from the semicircular plate so as to form a support for a thread dispensed at the feed, actuated needles of the needles of the first half of the needle cylinder being actuated so as to take up the thread and be alternated with inactive needles of the needles of the first half of the needle cylinder, subsequently swapping the actuated needles with the inactive needles when the motion of the needle cylinder is reversed; during the first step, in the forward and return motion of the needle cylinder, a first needle of the needles of the second half of the needle cylinder also being made to pass in front of the feed and being actuated so as to take up the thread, in order to allow both end hooks of the hooks of the semicircular plate to engage the thread;

a second step, during which the hooks of the semicircular plate are retracted into the semicircular plate retaining the engaged thread;

a third step, during which heel knitting is formed with the needles of the first half of the needle cylinder that have taken up the thread;

a fourth step, during which the semicircular plate is folded over about the diametrical axis so that the hooks of the semicircular plate, which have retained the thread, face the needles of the second half of the needle cylinder;

a fifth step, during which the hooks of the semicircular plate are partially extracted from the semicircular plate and the needles of the second half of the needle cylinder are also actuated, while the cylinder is rotated continuously about its own axis so as to form loops of knitting by means of the needles of the second half of the needle cylinder, the loops meshing with the thread carried by the hooks of the semicircular plate, which are then retracted into the semicircular plate in order to release the previously held and transferred thread; and a sixth step, during which the machine is actuated in order to complete the item.

One particular difference between the method according to the present invention and a method for example as described above as disclosed in the U.S. Pat. No. 5,727,400 resides in the provision according to which during the first step, in the forward and return motion of the needle cylinder, a first needle of the needles of the second half of the needle cylinder is also made to pass in front of the feed and is actuated so as to take up the thread, in order to allow both end hooks of the hooks of the semicircular plate to engage the thread. There is accordingly achieved a perfect closure of the toe which, without this provision, would inevitably have an effect similar to a ladder at one end of the closed portion of the toe.

BRIEF DESCRIPTION OF THE DRAWINGS

Further characteristics and advantages of the present invention will become apparent from the following description of a preferred but not exclusive embodiment of the method according to the invention, illustrated only by way of non-limitative example in the accompanying drawings, wherein.

DISCLOSURE OF THE PREFERRED EMBODIMENTS

Figure 1:
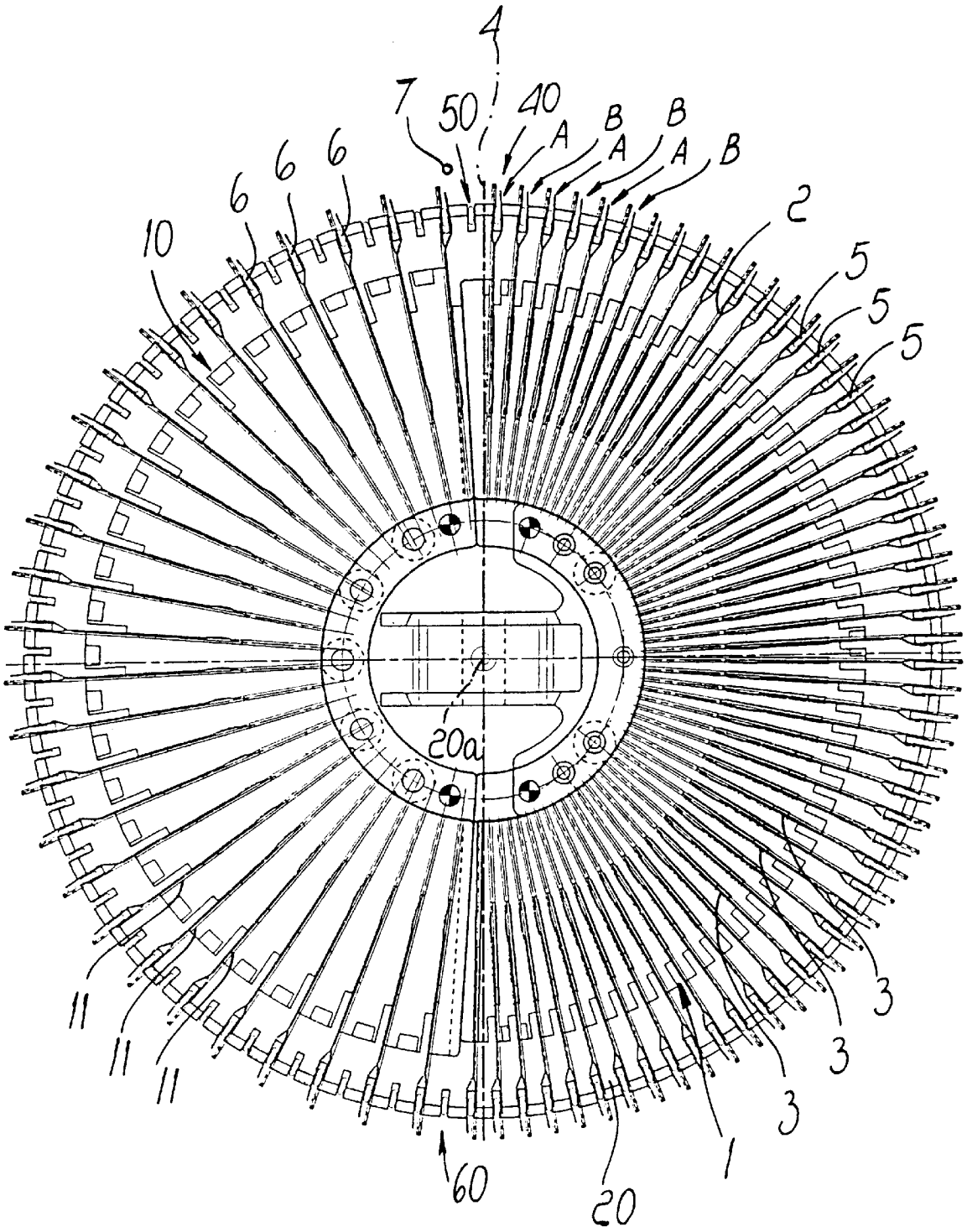
FIG. 1 is a schematic top plan view of the circular plate and of the needle cylinder of a single-cylinder circular hosiery-making machine.

With reference to the above figures, the method according to the present invention can be carried out with a single-cylinder circular hosiery-making machine which has a semicircular plate 1 which faces the upper end of the needle cylinder 20 and is provided with a plurality of hooks 2 which can move along radial slots 3 provided, in a manner known per se, inside the semicircular plate 1. The hooks 2 can be actuated, in a manner known per se, so that they can protrude with their tip or retract inside the slots 3 formed in the semicircular plate 1.

The semicircular plate 1 can be folded over on command about a diametrical axis 4 so that its hooks 2 face the needles 5 of a first half of the needle cylinder 20 or the needles 6 of the other half, or second half, of the needle cylinder 20.

It should be noted that the machine may be provided only with the semicircular plate 1, or with a full circular plate, arranged above and coaxially with respect to the needle cylinder 20, as shown, and composed of the fold-over semicircular plate 1 and of a fixed semicircular plate 10 in order to be able to perform, in addition to the method according to the present invention, processes which require the use of a full plate.

In particular, preference is given to the use of a machine of the kind disclosed and illustrated in U.S. Ser. No. 08/820,629, U.S. Pat. No. 5,816,075 in the name of the same Applicant and incorporated herein by reference.

Said machine is equipped with a circular plate which is composed of a semicircular plate 10 which is supported, in a fixed manner and on a substantially horizontal plane, above the needle cylinder 20 and is provided with a hook 11 for every two needles 6 of the half of the needle cylinder (or second half of the needle cylinder) which it faces, and of a fold-over semicircular plate 1 which is provided with a number of hooks 2 which is equal to the number of needles of the half of the needle cylinder above which it lies (or first half of the needle cylinder).

As disclosed in the above-mentioned Patent Application, the semicircular plate 1 can be folded over about a diametrical axis 4 of the needle cylinder with respect to the fixed semicircular plate 10 and can also be rotated, with respect to the fixed semicircular plate 10, about the axis 20*a* of the needle cylinder, together with said needle cylinder, so that it is overturned and laterally adjacent to the fixed semicircular plate 10 in a substantially co-planar arrangement.

It should be noted that the expression "fixed semicircular plate" means that the semicircular plate 10 cannot be folded over, but it is understood that said semicircular plate can rotate, like the semicircular plate 1, about the axis 20*a* of the needle cylinder rigidly with said needle cylinder and can be moved, in a manner known per se, about the axis 20*a* of the needle cylinder.

Preferably, the circular plate and particularly the fold-over semicircular plate 1 is equipped with hooks 2 of the kind disclosed and illustrated in U.S. Ser. No. 08/871,377, U.S. Pat. No. 5,855,122 in the name of the same Applicant and incorporated herein by reference.

Figure 2:
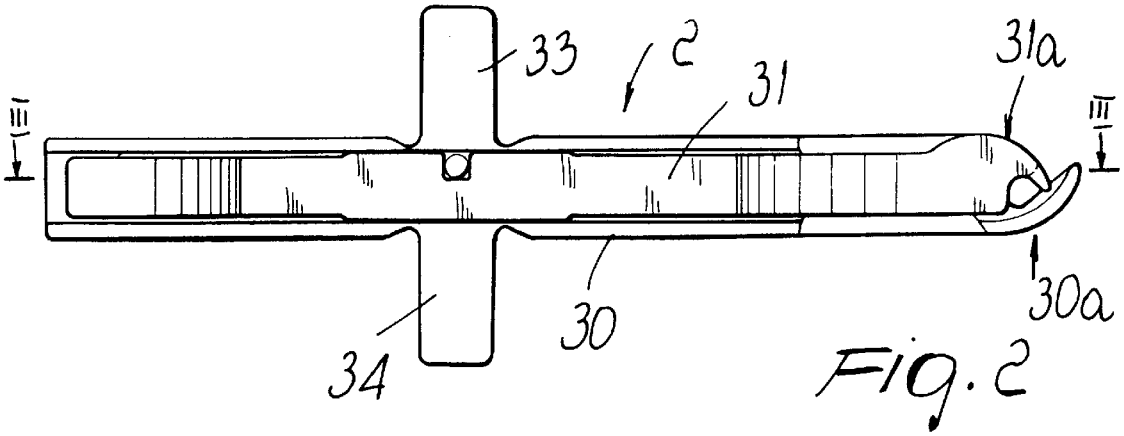
FIG. 2 is a lateral elevation view of a hook.
Figure 3:
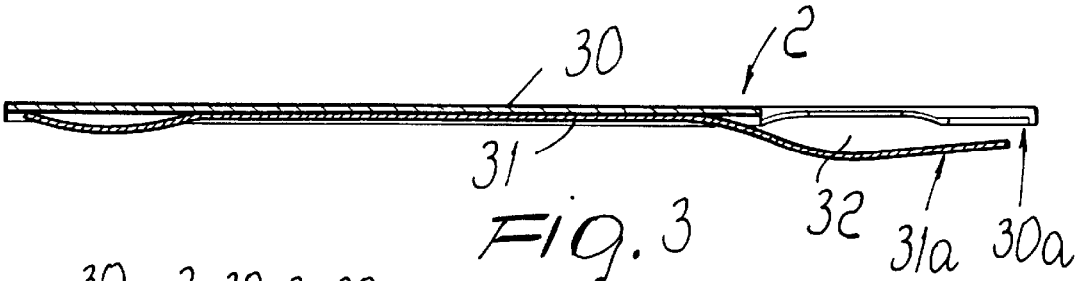
FIG. 3 is a sectional view of FIG. 2, taken along the plane III—III.

Said hooks 2, as shown in particular in FIGS. 2 and 3, have an elongated flat body 30 which has a curled longitudinal end 30*a*. Furthermore, each hook 2 comprises an elastic lamina element 31, which is associated with a lateral face of its body and has a curled end 31*a* which faces the curled end 30*a* of the body of the hook. A passage 32 is thus formed between the lamina element 31 and the hook body 30 which is adapted to be crossed by a needle of the hosiery-making machine. The curled end 31*a* of the lamina element 31 can also flex towards or away from the body 30 of the hook, respectively in order to close the curled end 30*a* of the body 30 of the hook and to allow the extraction of the needle, once it has been inserted in the passage 32, towards the curled end 30*a* of the hook body.

Furthermore, the hook 2 has two heels 33 and 34 which protrude, respectively in an upward direction and in a downward direction, from the body 30 of the hook in order to actuate it through conventional cams which face the circular plate in an upward region.

The method according to the present invention comprises a first step, during which the needle cylinder 20 is rotated alternately about its own axis 20*a* with at least one forward motion and one return motion, so as to move the needles 5 of the first half of the needle cylinder, above which the fold-over semicircular plate 1 is arranged, and the hooks 2 of said semicircular plate 1 so that they pass in front of a feed 7 of the machine.

During this first step, the hooks 2 of the semicircular plate 1 are extracted from the circular plate with their curled end, so as to form a support for the thread 8 dispensed at this feed 7, and the needles 5 of the first half of the needle cylinder are actuated so as to take up the thread fed at said feed 7. The needles 5 that take up the thread are alternated with needles which are kept inactive and the actuated needles are swapped with the inactive needles when the motion of the needle cylinder is reversed.

More particularly, as shown in FIG. 1, for example, during the forward motion of the needle cylinder, the odd needles of the first half of the needle cylinder that lies below the fold-over semicircular plate 1, i.e., the first needle, the third needle, the fifth needle, and so forth, referenced by the arrow A in FIG. 1, are lifted, while during said forward movement the even needles B, i.e., the second needle, the fourth needle, the sixth needle and so forth, are kept inactive, i.e., they are not actuated.

When the motion of the needle cylinder is reversed, the odd needles A are kept inactive and the even needles B are activated instead.

Figure 4:
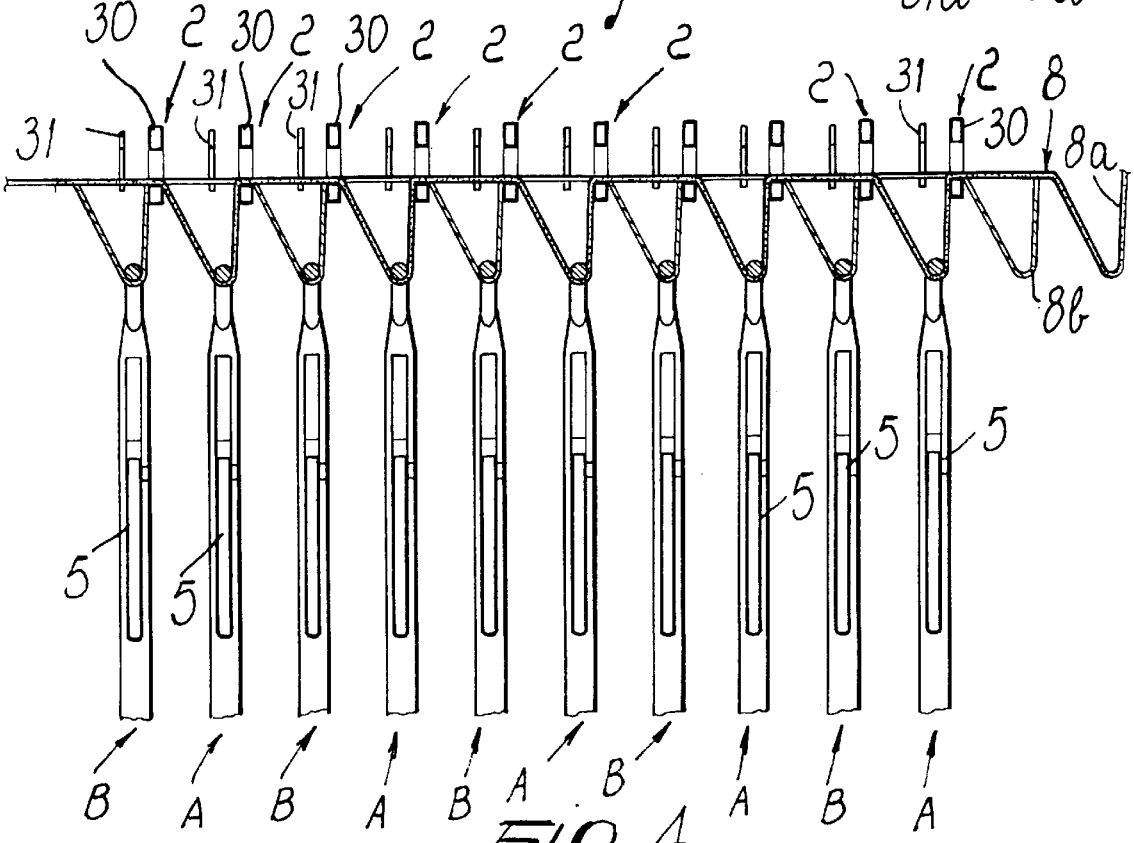
FIG. 4 is a schematic lateral elevation view of a group of needles of the needle cylinder and of a group of hooks during the first step of the method according to the invention.

In this manner, it is possible to obtain two threads which are deposited on the hooks 2 and are taken up respectively by the odd needles A and by the even needles B, as shown in FIG. 4. Actually, said two threads are two portions of a same thread 8 dispensed by the feed 7; however, for the sake of greater clarity, said two thread portions have been drawn differently and have been designated by the reference numerals 8*a* and 8*b* in said figure.

Preferably, the thread 8 is constituted by an elastic thread.

Owing to the fact that for each hook 2 of the folding semicircular plate 1 a needle 5 is provided, the thread taken up by a needle during the forward motion rests on the two hooks located between two contiguous odd needles A, while during the return motion the thread taken up by the even needles B rests on the two hooks that lie between two contiguous even needles.

Owing to the fact that the fold-over semicircular plate 1 necessarily begins with a hook 2 and ends with a needle 5, or viceversa, the initial hook of the semicircular plate, designated by the reference numeral 40, would not receive the thread 8 fed by the machine feed. Because of this, during this first step of the method, during the forward and/or return motion of the needle cylinder, said needle cylinder is actuated so that the first needle, referenced by the arrow 50, of the second half of the needle cylinder, or the needle of the second half of the needle cylinder which is closest to the initial hook 40 of the fold-over semicircular plate 1, also passes in front of the feed 7 that feeds the thread 8.

Accordingly, the thread 8, fed by the feed 7 during this first step, arranges itself on the initial hook 40 as well and is then retained thereby in the subsequent step.

The method then comprises a second step, during which the hooks 2 are retracted into the semicircular plate 1, so as to retain the thread 8, i.e., the two thread portions 8*a* and 8*b*, placed earlier on their tip.

A third step is then performed during which the machine is actuated so as to produce heel knitting, in a conventional manner, with the needles 5 of the first half of the needle cylinder which have taken up the thread 8, i.e., the needles located in the needle cylinder half above which the fold-over semicircular plate 1 is located.

In a fourth step of the method according to the invention, the semicircular plate 1 is folded over about the diametrical axis 4, so that its hooks 2, which have retained the thread 8 fed during the first step of the method, face the needles 6 of the second half of the needle cylinder.

During a fifth step of the method according to the invention, the hooks 2 are partially extracted from the semicircular plate 2 and the needles 6 of the other half of the needle cylinder are also actuated, while the needle cylinder is rotated continuously about its own axis so that the needles of the needle cylinder form loops of knitting.

Figure 5:
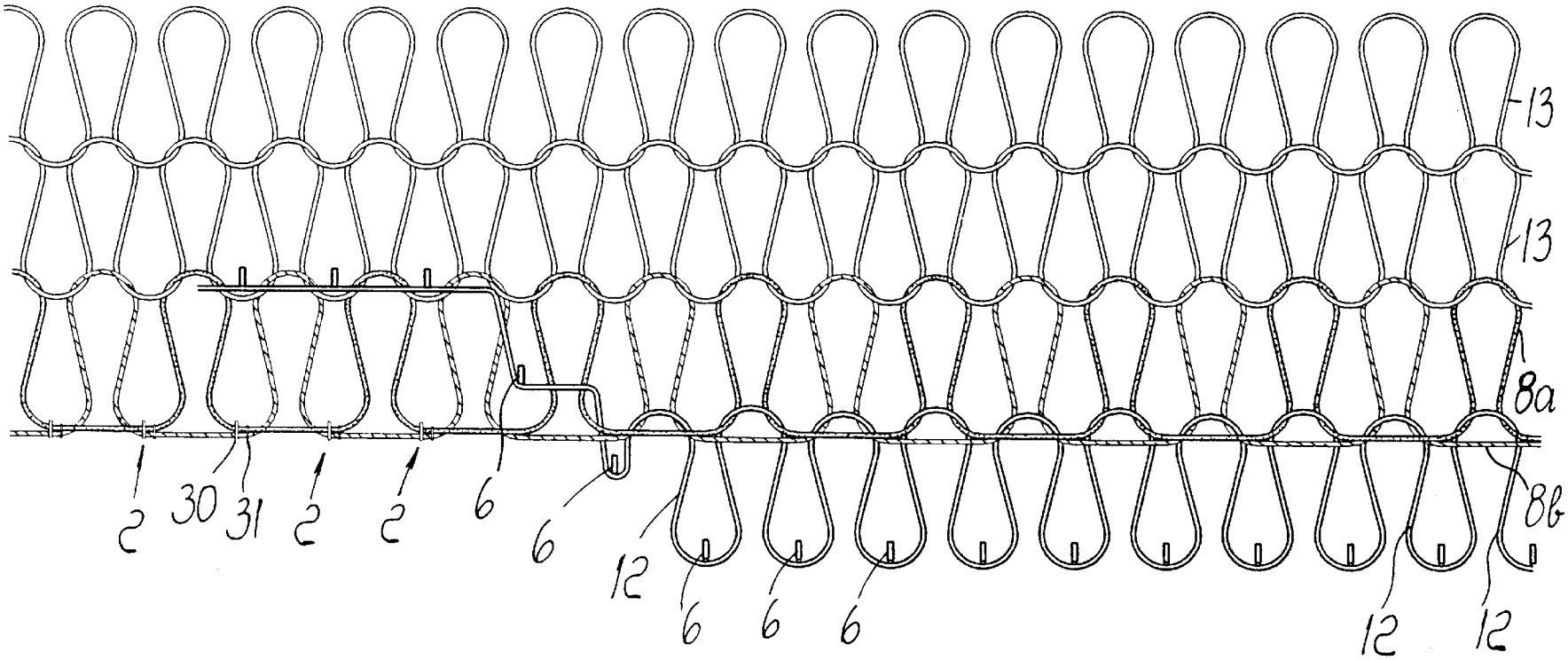
FIG. 5 is the loop structure resulting from the fifth step of the method according to the invention.

In particular, the needles 6 of the second half of the needle cylinder, over which the semicircular plate 1 has been folded, take up the thread 8 fed at a feed of the machine, passing through the passage 32 and therefore through the loops of thread 8*a* and 8*b* which are retained on the hooks 2, thus knitting in the new loops 12 with said loops retained by the hooks 2, as shown schematically in FIG. 5. In said figure, the loops 13 that lie above the loops formed by the threads 8*a* and 8*b* are the loops formed during the third step with heel knitting.

More particularly, at the beginning of the fifth step, each hook 2 supports two loops which are formed respectively by the threads 8*a* and 8*b* which, as a consequence of the knitting performed in the first step, overlap exactly at the curled end of the hook 2, and the new loops formed by the needles 6 pass through the overlap regions of the loops formed by the threads 8*a* and 8*b*, as shown in FIG. 5.

During the descent of the needles in the forming of these new loops, the hooks 2 are retracted into the semicircular plate so as to release the loops that had formed during the first step of the method.

It should be noted that after the fold-over semicircular plate 1 has been folded over above the second half of the needle cylinder, said semicircular plate 1, together with the needle cylinder, is rotated substantially through 180°, while the fixed semicircular plate 10 stands still and the semicircular plate 1 is returned to a position in which it is substantially co-planar to the fixed semicircular plate 10 but is turned over, as disclosed in the above cited U.S. Ser. No. 08/820,629 in the name of the same Applicant.

Finally, a sixth step is performed during which the machine is actuated so as to complete the item in a conventional manner which is not described further for the sake of simplicity.

In practice, with the method according to the present invention it is possible to produce, with a single-cylinder circular machine, closed-toe hosiery items with a kind of closure which is comparable with conventional looping in terms of quality and aesthetic effect.

In particular, owing to the fact that during the first step of the method the first needle of the second half of the needle cylinder, which in this step is not affected by the fold-over semicircular plate, is made to knit as well, one achieves perfect closure of the toe which, without this refinement, would inevitably have an effect similar to a ladder at one end of the closed portion of the toe.

Preferably, in order to achieve even greater closure safety at both ends of the toe closure portion, during the first step of the method it is possible to also make the last needle of the second half of the needle cylinder, designated by the arrow 60, move so as to take up the thread 8 dispensed at the feed 7.

In practice, it has been observed that the method according to the present invention fully achieves the intended aim, since it allows to produce hosiery items or similar products having a closed toe directly on the single-cylinder circular machine that produces them, with a result which is highly effective from a qualitative point of view and with competitive production costs.

The method thus conceived is susceptible of numerous modifications and variations, all of which are within the scope of the inventive concept; furthermore, all the details may be replaced with other technically equivalent elements.

In practice, the materials used, as well as the dimensions, may be any according to requirements and the state of the art.

What is claimed is:

1. A method for manufacturing a tubular hosiery item with a closed end, with a single-cylinder circular knitting machine, which is provided with a semicircular plate and a needle cylinder, said semicircular plate facing, in an upward region, a first half of the needle cylinder, said semicircular plate being adapted to fold over about a diametrical axis of the needle cylinder in order to face a second half of the needle cylinder, hooks being provided on said semicircular plate which are radially movable with respect to an axis of the needle cylinder, said hooks being equal in number to a number of needles located in an underlying half of the needle cylinder selected from said first and second halves of the needle cylinder such that each hook is laterally adjacent to a needle of the underlying half of the needle cylinder, the method comprising:

a first step, during which the needle cylinder is rotated alternately about said axis of said needle cylinder with at least one forward movement and one return movement, for moving the needles of the first half of the needle cylinder and the hooks of the overlying semicircular plate so that the needles of the first half of the needle cylinder and the hooks of the semicircular plate pass in front of a feed of the machine; the hooks of the semicircular plate being partially extracted, during said first step, radially from said semicircular plate so as to form a support for a thread dispensed at said feed, actuating needles of the needles of the first half of the needle cylinder so as to take up said thread and be alternated with inactive needles of the needles of the first half of the needle cylinder, subsequently swapping the actuated needles with the inactive needles when the motion of the needle cylinder is reversed; during said first step, in the forward and return motion of the needle cylinder, a first needle of the needles of the second half of the needle cylinder also being made to pass in front of said feed and being actuated so as to take up the thread, in order to allow both end hooks of the hooks of the semicircular plate to engage the thread;

a second step, during which the hooks of the semicircular plate are retracted into the semicircular plate, retaining the engaged thread;

a third step, during which heel knitting is formed with the needles of the first half of the needle cylinder that have taken up the thread;

a fourth step, during which the semicircular plate is folded over about said diametrical axis so that the hooks of the semicircular plate, which have retained the thread, face the needles of the second half of the needle cylinder;

a fifth step, during which the hooks of the semicircular plate are partially extracted from the semicircular plate and the needles of the second half of the needle cylinder are also actuated, while the cylinder is rotated continuously about its own axis so as to form loops of knitting by means of the needles of said second half of the needle cylinder, said loops meshing with the thread carried by said hooks of the semicircular plate, which are then retracted into the semicircular plate in order to release the previously held and transferred thread; and a sixth step, during which the machine is actuated in order to complete the item.

2. The method according to claim 1, wherein during said first step, during the forward and return motion of the needle cylinder, a last needle of the needles of the second half of the needle cylinder also is made to pass in front of said feed and is actuated so as to take up the thread.

3. The method according to claim 1, wherein the thread fed by said feed during said first step is an elastic thread.

4. The method according to claim 1, wherein after being folded over, the semicircular plate is rotated together with the needle cylinder, about the needle cylinder axis, through an angle of substantially 180°.

5. The method according to claim 1, comprising providing each of said hooks of said semicircular plate having an elongated flat body, in which a longitudinal end is curled; an elastic lamina which is associated with a lateral face of the body of the hook and is provided with a curled end which faces the curled end of the hook body; a passage which is formed between said lamina element and said hook body and is adapted to be crossed by a needle of the hosiery-making machine; said curled end of the lamina element being flexible towards and away from the hook body, respectively in order to close the curled end of the hook body and in order to allow to extract the needle inserted in said passage towards the curled end of the hook body; and wherein during said fifth step the needles of the second half of the needle cylinder knit in new loops, passing through the passage formed between the lamina element and the body of the corresponding hook with, the threads placed, during said first step, at the curled end of the hooks.

6. The method according to claim 5, wherein during said fifth step, each one of the new loops formed by the needles of the second half of the needle cylinder is passed through an overlap region, which rests on the curled end of the corresponding hook, of two loops formed during said first step.

* * * * *